United States Patent [19]

Takahashi et al.

[11] Patent Number: 5,005,024

[45] Date of Patent: Apr. 2, 1991

[54] INK JET RECORDING APPARATUS WHICH SUPPLIES REPELLENT AGENT TO LIQUID DISCHARGE PORT SURFACE AND METHOD THEREOF

[75] Inventors: Hiroto Takahashi, Atsugi; Seiichiro Karita, Yokohama; Koichi Sato, Hiratsuka, all of Japan

[73] Assignee: Canon Kabushiki Kaisha, Tokyo, Japan

[21] Appl. No.: 489,831

[22] Filed: Mar. 2, 1990

Related U.S. Application Data

[63] Continuation of Ser. No. 174,815, Mar. 29, 1988, abandoned.

[30] Foreign Application Priority Data

Mar. 31, 1987 [JP] Japan ..... 62-076352
Mar. 14, 1988 [JP] Japan ..... 63-0760102
Mar. 14, 1988 [JP] Japan ..... 63-0760105

[51] Int. Cl.[5] ..... B41J 2/165; B41J 2/05
[52] U.S. Cl. ..... 346/1.1; 346/140 R
[58] Field of Search ..... 346/1.1, 140

[56] References Cited

U.S. PATENT DOCUMENTS 3,346,869 10/1967 Stone ..... 346/75
4,368,476 1/1983 Uehara ..... 346/140
4,540,997 9/1985 Biggs ..... 346/140
4,734,706 3/1988 Le ..... 346/140 X

FOREIGN PATENT DOCUMENTS 0121623 10/1984 European Pat. Off. .
0178886 4/1986 European Pat. Off. .
2519160 9/1976 Fed. Rep. of Germany .
2112715 8/1982 United Kingdom .
2123755 2/1984 United Kingdom .

OTHER PUBLICATIONS

Quach, Ahn; Ink Jet Cleaning; Xerox Disclosure Journal, vol. 7, No. 5, 1982, p. 323.
Patent Abstracts of Japan, M-389, vol. 9, No. 146 (1985).

*Primary Examiner*—Joseph W. Hartary
*Attorney, Agent, or Firm*—Fitzpatrick, Cella, Harper & Scinto

[57] ABSTRACT

In a liquid injection recording apparatus wherein recording liquid is discharged from discharge ports provided in the discharge port surface of a recording head to make flying liquid droplets to thereby accomplish recording, liquid-repellent process means capable of applying a liquid-repellent agent for repelling the recording liquid adhering to the discharge port surface is provided to the discharge portion surface from a position capable of being opposed to the discharge port surface.

53 Claims, 16 Drawing Sheets

| |
|---|
| FIG. 5A |
| FIG. 5B |

INK JET RECORDING APPARATUS WHICH SUPPLIES REPELLENT AGENT TO LIQUID DISCHARGE PORT SURFACE AND METHOD THEREOF

This application is a continuation of application Ser. No. 174,815, filed Mar. 29, 1988.

BACKGROUND OF THE INVENTION

1. Field of the Invention

This invention relates to liquid injection recording apparatus, and more particularly to an apparatus in which recording liquid is discharged from an orifice onto a recording medium by discharge energy generating means to make flying liquid droplets, thereby accomplishing recording.

2. Related Background Art

In the heretofore known liquid injection recording apparatus such as, for example, the bubble jet (BJ) type recording apparatus (U.S. Pat. No. 4,723,129, etc.), it is known that the recording head used therein comprises a plurality layers of materials or members (e.g. U.S. Pat. Nos. 4,417,251, 4,394,670, 4,521,787, etc.). In FIG. 1 of the accompanying drawings, there is shown an example of the layered state of such a recording head, wherein silicon (Si) is used for a substrate 1, a silica ($SiO_2$) layer 2 is provided thereon, and a dry film layer 4 of acrylic resin including a nozzle 3 formed by photolithography and a glass layer 5 are further layered thereon (a discharge energy generating element is omitted). In the recording head thus constructed, when an electrical signal is supplied to discharge energy generating means, a bubble is created in a BJ type liquid path. Recording liquid is thus discharged from a discharge port 6 by a liquid droplet which flies out in the direction of arrow A.

In the conventional recording head as described above constructed of layers of a plurality of kinds of different materials as described above, wettability differs on the discharge port surface 7 (the surface in which the discharge port is disposed). For, example, wettability is higher on the $SiO_2$ than on the other layers. Thus, particularly, when the frequency of the electrical signal is increased, the drop 8 is "pulled" by a member which is formed of a material of good wettability of the accompanying as shown in FIG. 2 of the accompanying Therefore, the liquid droplet (not shown) discharged from the discharge port 6 is pulled toward the drop 8 as indicated by arrow B such that a large of kink is produced in the scan direction, resulting in lowered recording performance (for example, U.S. Pat. No. 4,499,480).

In order to prevent the drop described above, it is conceivable to uniformize the surface roughness of the discharge port surface (U.S. Pat. No. 4,499,480), to form the discharge port surface of one and the same material (U.S. Pat. Nos. 4,521,787 and 4,417,251) or to coat the discharge port surface with a liquid-repellent substance, (U.S. Pat. No. 4,723,129). Especially, coating the discharge port surface with a liquid repellent substance can solve the drop problem both simply and effectively because it requires no change in the structure of the recording head itself. However, particularly in the recording head of the above-described construction, the discharge port surface is such that different materials are exposed, so it is difficult to choose a durable liquid repellent material. Thus, a method of occasionally manually applying a liquid-repellent material is also known.

However, manually coating the discharge port surface of the recording head with a liquid-repellent material as required takes much time and requires skill liquid-repellent material is not applied to the discharge port surface or unnecessarily enter the recording head through the discharge ports, and thus, is not preferable from the viewpoint of maintenance.

Moreover, even when the liquid-repellent process has been imparted on the discharge port surface, excess recording liquid has often adhered to and remained on the discharge port surface, and foreign materials such as dust and the like have sometimes adhered to the discharge port surface. Numerous methods to remove such excess recording liquid and foreign materials from the discharge port surface include wiping the discharge port surface by means of a plate member such as a rubber blade is very effective to solve the above-noted problem. However, since the plate member performs its wiping function by contacting the discharge port surface and being moved relative thereto, this has sometimes required choosing a material with high durability such as wear resistance to the liquid-repellent or anti-stripping property. That is, it has been necessary to choose a material while taking into account the physical characteristic of the coating formed by the liquid-repellent process material, more than the congeniality between the material of the discharge port surface of the recording head and the liquid-repellent process material. This has led to great difficulties in choosing the useful liquid-repellent substance.

SUMMARY OF THE INVENTION

It is an object of the present invention to solve the above-noted problems peculiar to the prior art and to provide a liquid injection recording apparatus which enables the liquid-repellent process of the discharge port surface to be reliably carried out with a simple structure, whereby the direction of discharge of liquid droplets can be uniformized to accomplish recording of high quality.

It is another object of the present invention to provide a liquid injection recording apparatus in which recording liquid is discharged from discharge ports provided in the discharge port surface of a recording head to make flying liquid droplets, thereby accomplishing recording, and in which liquid-repellent process means capable of applying a liquid-repellent process agent repelling the recording liquid adhering onto said discharge port surface is provided at a position capable of being opposed to said discharge port surface.

It is still another object of the present invention to provide a liquid injection recording apparatus in which said liquid-repellent process means is near the home position of the recording head and/or said liquid-repellent process means has a storage box for said liquid-repellent process agent, a coating member impregnated with said liquid-repellent process agent can be protruded from and received in said storage box and an opening through which the coating member protrudes can be closed.

It is also an object of the present invention to propose a liquid-repellent process method for a liquid injection recording apparatus which is provided with a recording head having a discharge port surface in which discharge ports for discharging liquid therethrough are disposed, recording head moving means capable of moving said recording head along a recording medium, and liquid-repellent process means for effecting the liquid-repellent process on said discharge port surface, and wherein the liquid-repellent process is effected on said discharge port surface by said liquid-repellent process means when the movement of said recording head has reached a predetermined number.

It is another object of the present invention to provide a liquid injection recording apparatus having a recording head provided with a discharge port surface in which discharge ports for discharging liquid therethrough are disposed, recording head moving means for making said recording head reciprocally movable along a recording medium, liquid-repellent process means provided within the range of movement of said recording head so as to be capable of being opposed to said discharge port surface for applying a liquid-repellent process agent repelling said liquid to said discharge port surface, and control means having counting means for counting the number of times of the movement of said recording head and effecting the liquid-repellent process on said discharge port surface on the basis of the information from said counting means.

The feature of the present invention which achieves such objects, that in briefly described, is that in a liquid injection recording apparatus wherein recording liquid is from discharge ports provided in the discharge port surface of a recording head to make flying liquid droplets to thereby accomplish recording having liquid-repellent process means for applying a liquid-repellent process agent which repels the recording liquid adhering onto the discharge port surface, the liquid-repellent process means being provided at a position which can be opposed to the discharge port surface.

DESCRIPTION OF THE PREFERRED EMBODIMENTS

Some embodiments of the present invention will hereinafter be described in detail and specifically with reference to the drawings.

Figure 1:
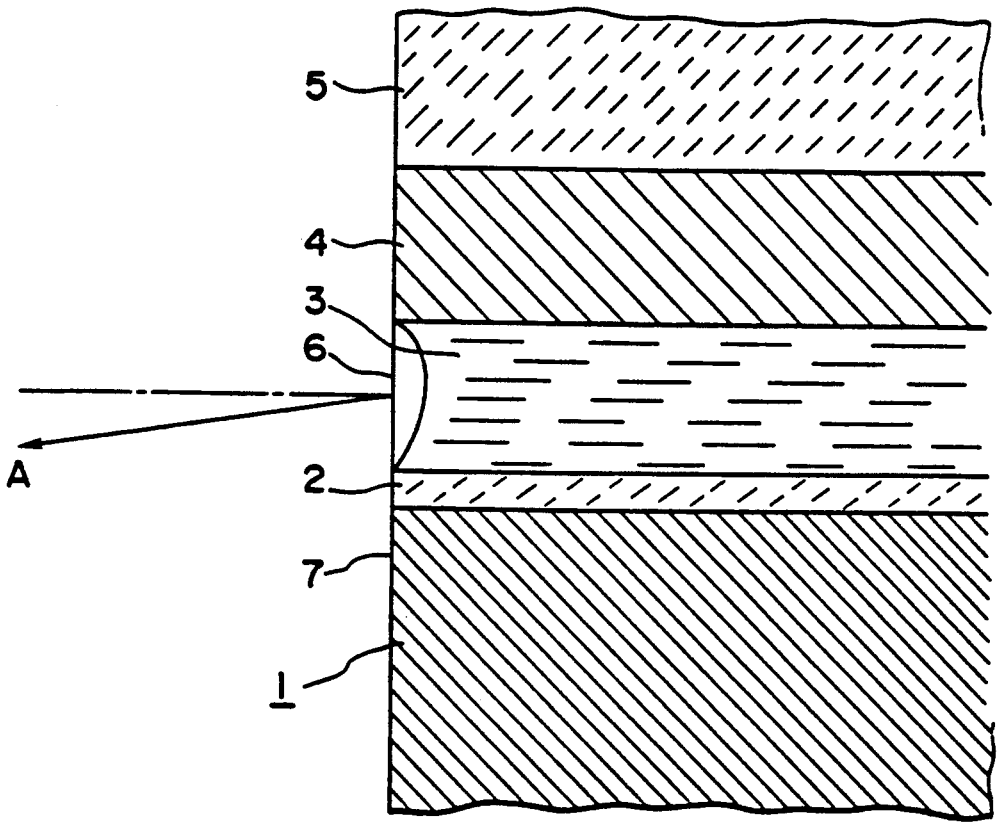
FIG. 1 PRIOR ART
FIG. 1 is a schematic cross-sectional view schematically showing the layered construction in a popular recording head.
Figure 2:
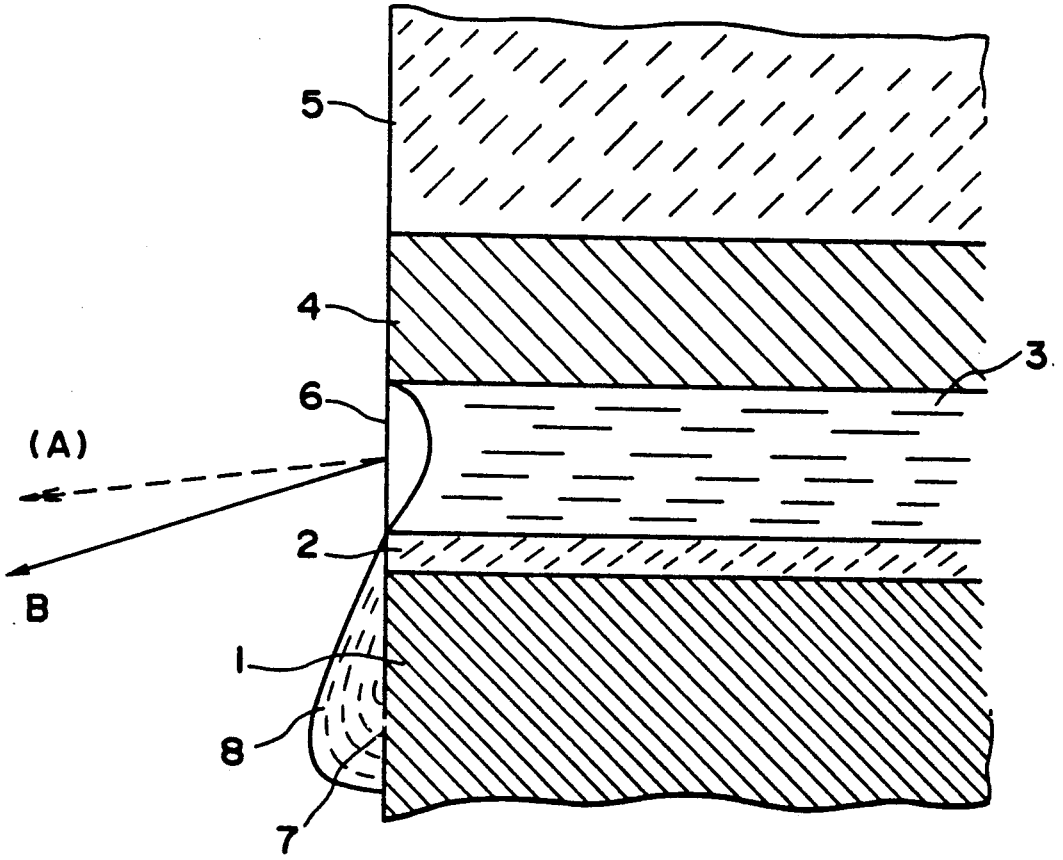
FIG. 2 PRIOR ART
FIG. 2 is a schematic cross-sectional view showing a state in which a drop of recording liquid hangs low on the discharge port surface of the recording head shown in FIG. 1.
Figure 3:
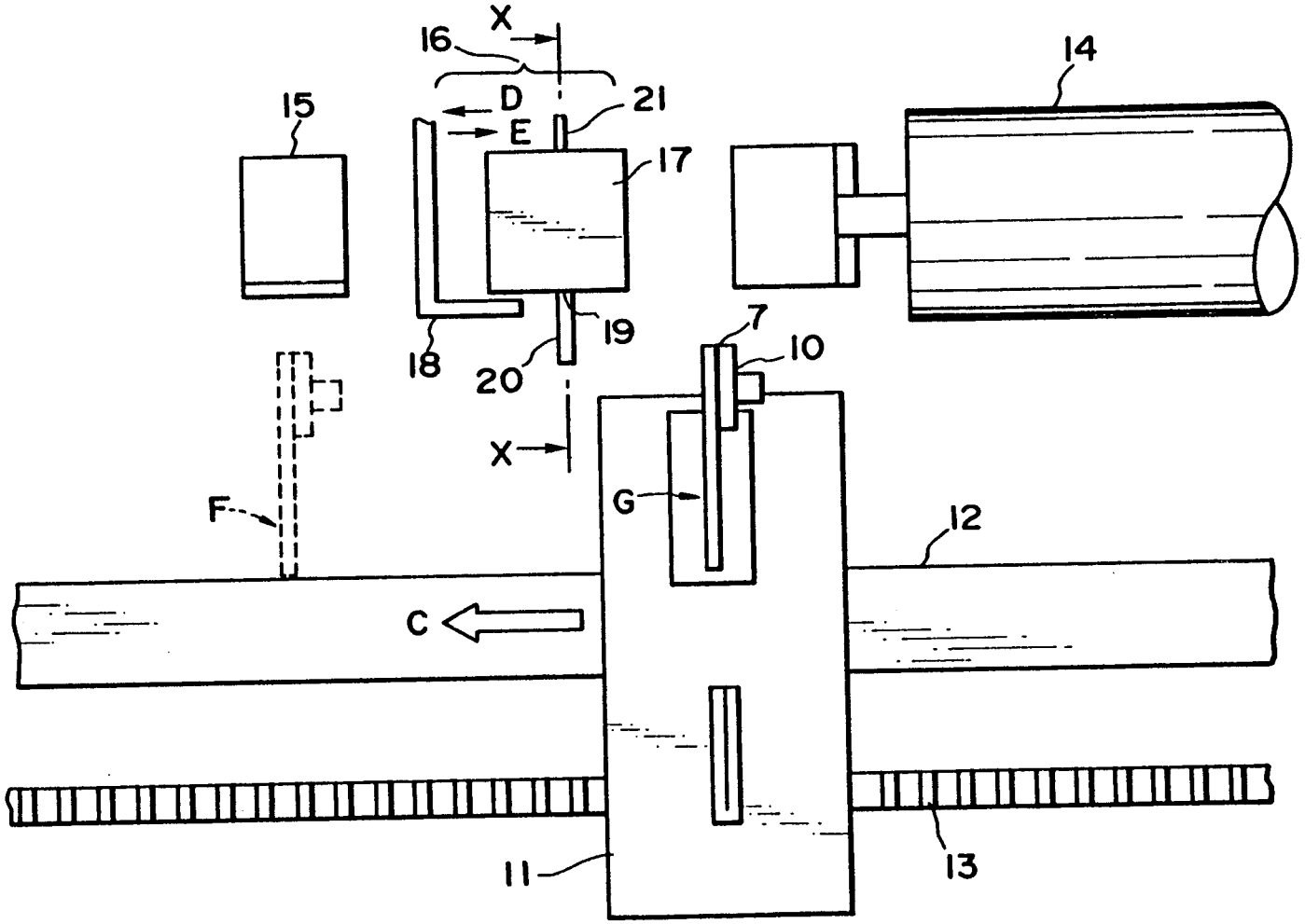
FIG. 3 is a schematic view showing a preferred example of the construction of the liquid injection recording apparatus of the present invention.

FIG. 3 shows a preferred embodiment of the present invention. In FIG. 3, the reference numeral 10 designates a recording head carried on a carriage 11, the reference numeral 12 denotes a rail on which the carriage 11 is moved, and the reference numeral 13 designates a carriage driving belt having its opposite ends fixed to the carriage 11 and driven by a motor, not shown. Thus, recording liquid (in the present embodiment, an aqueous recording liquid) is discharged from the recording head while the carriage is moved along a platen 14, whereby the recording liquid is made into flying liquid droplets and recording is effected on a recording medium on the platen 14. In the present embodiment, a cap member 15 for covering the discharge port surface 7 of the recording head when the carriage 11 has been directed to the home position (the head position F) is provided at a position opposed to the discharge port surface. Further, in the present embodiment, a liquid-repellent process unit 16 is provided near the cap member on the way from the recording area to the home position.

Figure 4:
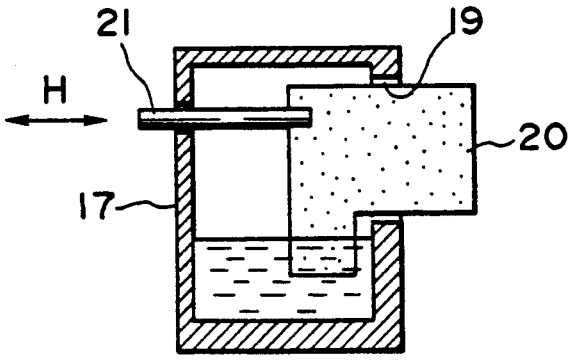
FIG. 4 is a schematic cross-sectional view of the liquid-repellent process means shown in FIG. 3 taken along line X—X of FIG. 3.

That is, in the present embodiment, the recording head 10 is moved in the direction of arrow C by the carriage 11 and on its way to the home position, a liquid-repellent agent is applied to the discharge port surface 7 by the liquid-repellent process unit 16 to thereby accomplish the liquid-repellent process. In the present embodiment, the liquid-repellent process unit 16 is constituted by a liquid-repellent agent storage box 17 and a closure plate 18. The liquid-repellent agent storage box 17, as shown in FIG. 4, has an opening 19 in which a coating plate 20 formed of a porous elastic material is held so as to be able to enter and exit. The reference numeral 21 designates moving means for the coating plate 20. In the present embodiment, the moving means 21 is a guide bar which may be withdrawn inwardly from the position as shown (movable in the directions of bilateral arrow H). In the present embodiment, the coating plate 20 is designed to be capable of being outwardly and inwardly protruded through the opening 19 by unillustrated drive means (such as a motor or a solenoid) or manually. A specific example of the construction thereof will be described later.

When the liquid-repellent process was to be carried out, the closure plate 18 was moved in the direction of arrow D indicated in FIG. 3 and the coating plate 20 was protruded outwardly from the opening 19 as shown, and the carriage 11 was moved so that the recording head was moved in the direction of arrow C from a position G and passed the position of the liquid-repellent process unit 16. At this time, the coating plate 20 impregnated with the liquid-repellent agent slidably contacted the discharge port surface 7 of the recording head 10 and wiped off both any dust on the discharge port surface and the excluded recording liquid in such a manner as to sweep the discharge port surface. At the same time, the liquid-repellent agent was applied to said surface.

Once such liquid-repellent process has been carried out, it is preferable to reciprocally move the recording head 10 for the purpose of drying without causing it to discharge the recording liquid. On the other hand, after the liquid-repellent process, the liquid-repellent process unit 16 was brought into a position in which the coating plate 20 was received therein through the opening 19, and the closure plate 18 was moved in the direction of arrow E to close the opening 19, whereby evaporation of the liquid-repellent agent was prevented.

As a preferred example of the liquid-repellent agent, mention may be made, for example, of FS-116 (registered trademark of Daikin) dissolved 2–3% in a solvent, Daifron S-3 (registered trademark of Daikin). Of course, however, another known material which has the liquid-repellent effect and does not adversely affect the recording liquid and the recording head can also be used as the liquid-repellent agent. In the present embodiment, after such a liquid-repellent agent was applied, 2-line desiccation scanning was carried out and recording was effected. As a result, it was be confirmed that the liquid-repellent agent had the liquid-repellent effect for one hundred strokes of the carriage. Also, when the liquid-repellent process was carried out every one hundred cycles of recording and the test was continued up to 3,000 sheets of recording paper of size A4, it was confirmed that as compared with the prior art, the amount of kink of a flying liquid droplet in the direction of scan (i.e., the amount of disturbance of the flight of a liquid droplet) could be noticeably reduced.

In the above-described embodiment, the coating plate is provided in the liquid-repellent process unit, whereas even if a coating roller free to go into and out of the storage box was used instead of the coating plate, a sufficient liquid-repellent process could of course be accomplished. Also, controlling the driving of the liquid-repellent process unit, i.e., the operation of protruding and housing the coating member, so that the number of scans of the carriage is counted by count means and then control means is automatically operated in accordance with the count number could lead to a preferable result as viewed from the viewpoint of automatization.

An example of the flow of the liquid-repellent process of the above-described embodiment will now be described with reference to the drawings.

Figures 5, 5A:
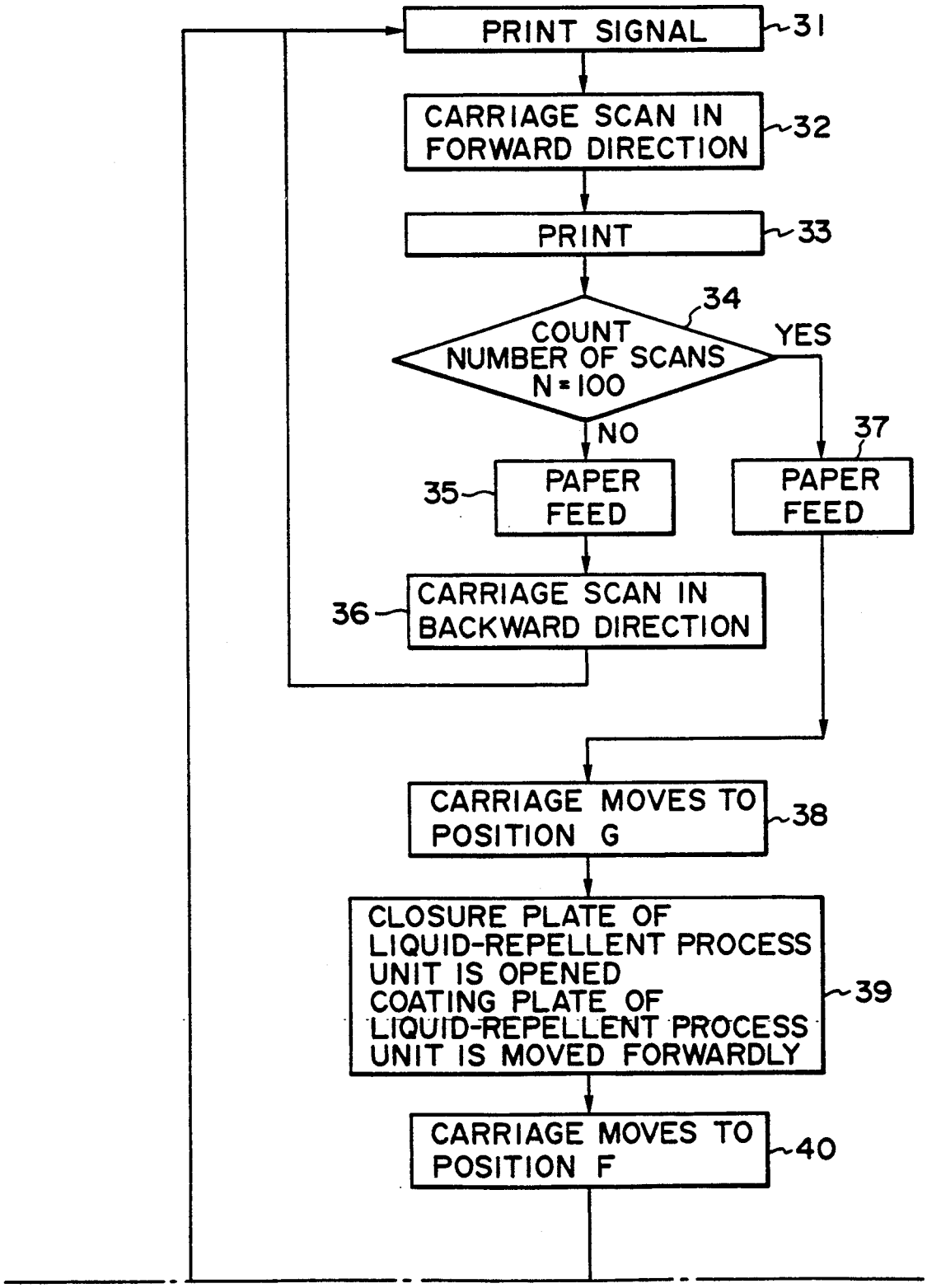
FIGS. 5A and 5B are a flow chart for illustrating an example of the flow of the liquid-repellent process in a preferred embodiment of the present invention.
Figure 5B:
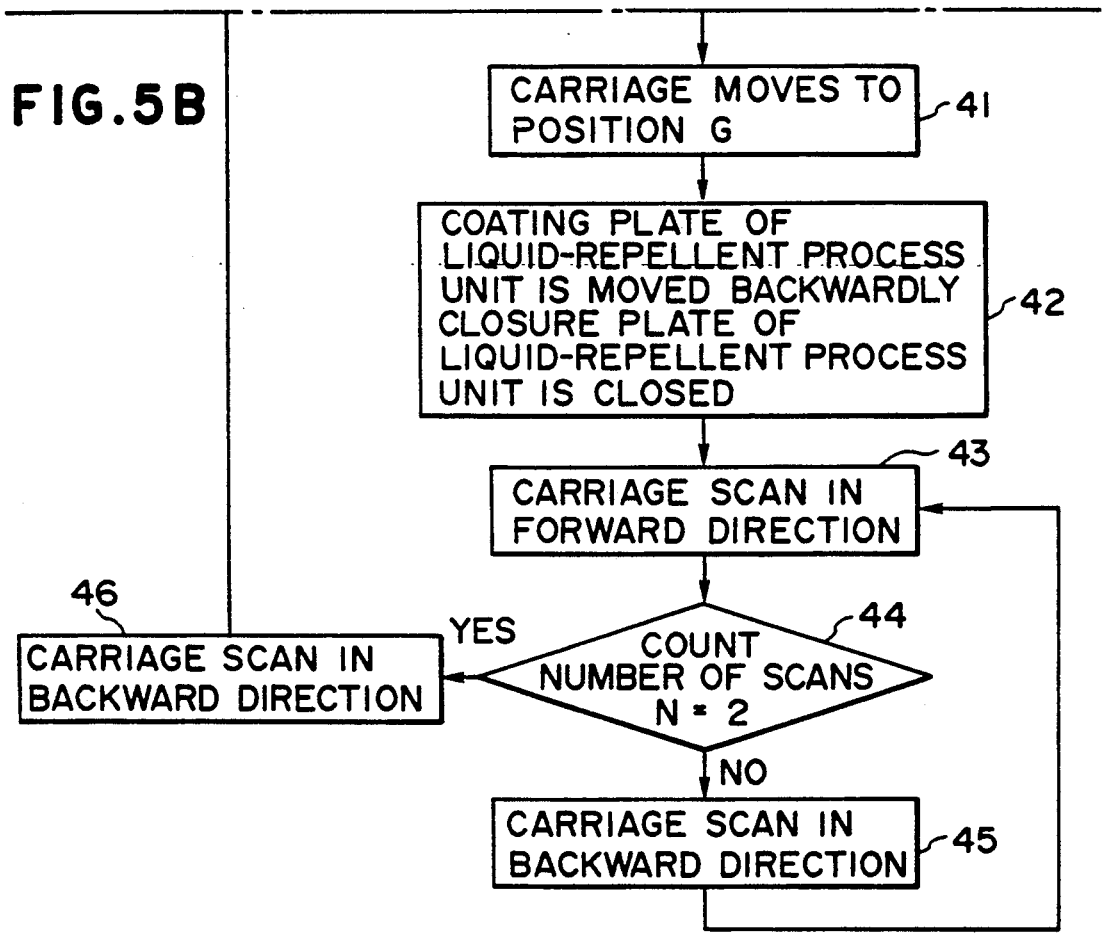

Referring to FIG. 5, when a print signal is input (31), the carriage scans in the forward direction (32) and liquid droplets are discharged from the recording head in accordance with the print signal, whereby printing is effected on the recording medium (33). The number of scans of the carriage is then counted (34) and if the number N of counts is less than a predetermined number (in the present embodiment, 100), paper feed is effected by a desired amount (35) and the carriage scans in the backward direction (36), and this is repeated if the print signal is input. If the number N reaches 100 during the count of the number of scans (34), paper feed is effected by a desired amount (37), whereafter the carriage is moved to the position G (38). That is, the printing state pauses once. The closure plate of the liquid-repellent process unit is opened and the coating plate is moved forwardly (moved toward the moved area of the recording head) (39). By the carriage being moved to the position F, i.e., the capping position (40), the coating plate comes into contact with the discharge port surface and the liquid-repellent process is carried out, and by the direction of movement of the carriage being reversed and the carriage being moved to the position E (41), the liquid-repellent process is carried out again. Thereafter, the coating plate is retracted, and the closure plate of the liquid-repellent process unit is moved and the closure plate is closed (42). The carriage scans in the forward direction (43) and the number N′ of scans is counted (44). If the number N′ of scans is not a predetermined number (in the present embodiment, 2) (this numerical value is determined by the time required for the drying or the like of the processing liquid adhering to the recording head), the carriage is again caused to scan in the backward direction (45), whereafter the carriage is caused to scan in the forward direction (43). When the number N′ reaches 2, the carriage scans in the backward direction (46) and again receives the print signal (31) to thereby continue the printing.

Figure 6:
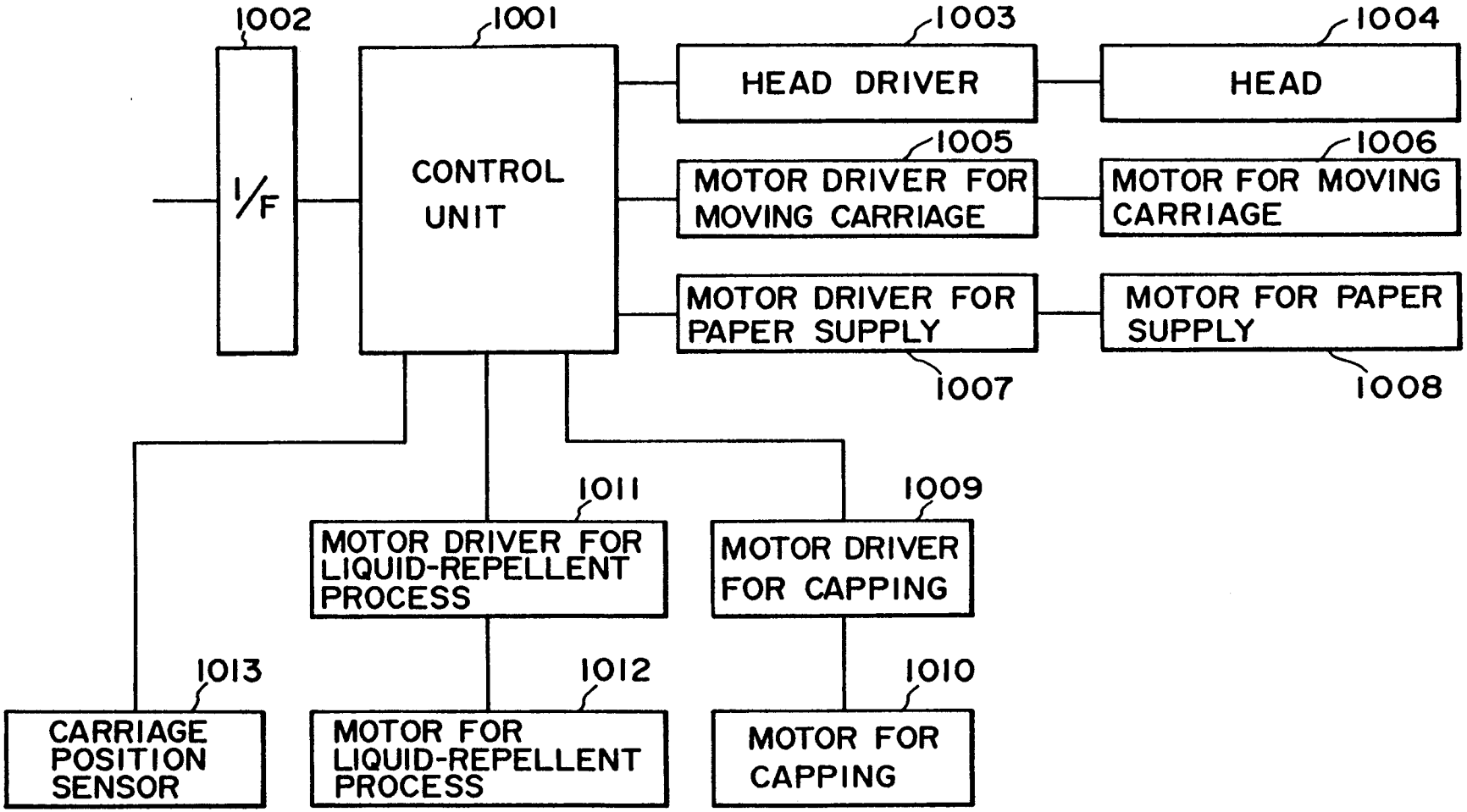
FIG. 6 is a block diagram used in a preferred embodiment of the present invention.

A block diagram for achieving this embodiment is schematically shown in FIG. 6. As shown in FIG. 6, a signal input to a control unit 1001 through an interface 1002 is input as a print signal to a head driver 1003, from which it is input as a drive signal to a head 1004. A motor driver 1005 for moving the carriage outputs a drive signal to a motor 1006 for moving the carriage, in order to move the carriage in response to the print signal or to move the carriage with the liquid-repellent process, the capping, etc. Also, a motor driver 1007 for paper supply provides an output for driving a motor 1008 for paper supply in accordance with the output from the control unit 1001. A motor driver 1009 for capping provides an output for driving a motor 1010 for capping for moving a cap mechanism when capping is effected on the recording head 1004. A motor driver 1011 for liquid-repellent process provides an output for driving a motor 1012 for liquid-repellent process for effecting movement of the coating plate and movement of the closure plate when the liquid-repellent process is carried out. A carriage position sensor 1013 is provided to detect the position of the carriage. The output of the carriage position sensor 1013 is input to the control means 1001, and the output of the carriage position sensor is counted in the control unit to provide the number of carriage scans That is, in the present embodiment, count means is provided in the control means.

Of course, the control means 1001 collectively controls the movement of each mechanism in association with the recording operation, the capping operation and the liquid-repellent operation.

FIGS. 7A, 7B, 8A and 8B are schematic views of a moving mechanism for the coating plate in the present embodiment.

In FIGS. 7A, 7B, 8A and 8B, the reference numeral 17 designates a liquid-repellent agent storage container, the reference numeral 18′ denotes a closure plate, the reference numeral 18′-1 designates a moving bar for the closure plate 18′, the reference numeral 18′-2 denotes a cam, the reference numeral 18′-3 designates a motor, the reference numeral 18′-4 denotes a groove, the reference numeral 18′-5 designates a pivotal portion, the reference numeral 18′-6 denotes a moving plate connected to the closure plate 18′, the reference numeral 20 designates a coating plate, and the reference numeral 21 denotes a guide bar.

Figure 8A:
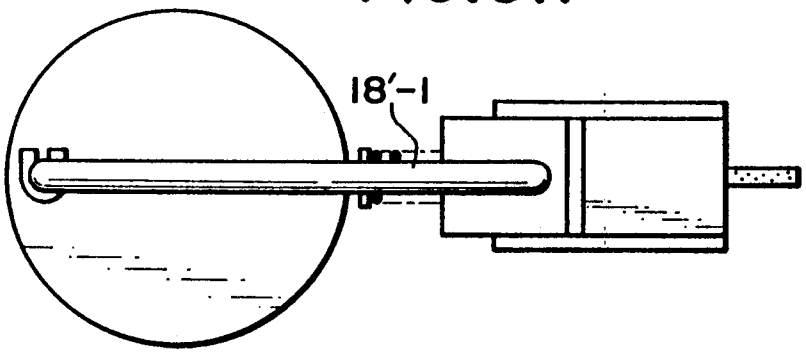
FIGS. 7A, 7B, 8A and 8B are schematic views of liquid-repellent process means used in a preferred embodiment of the present invention, FIGS. 7A and 8A being schematic top plan views, and FIGS. 7B and 8B being schematic side views.
Figure 8B:
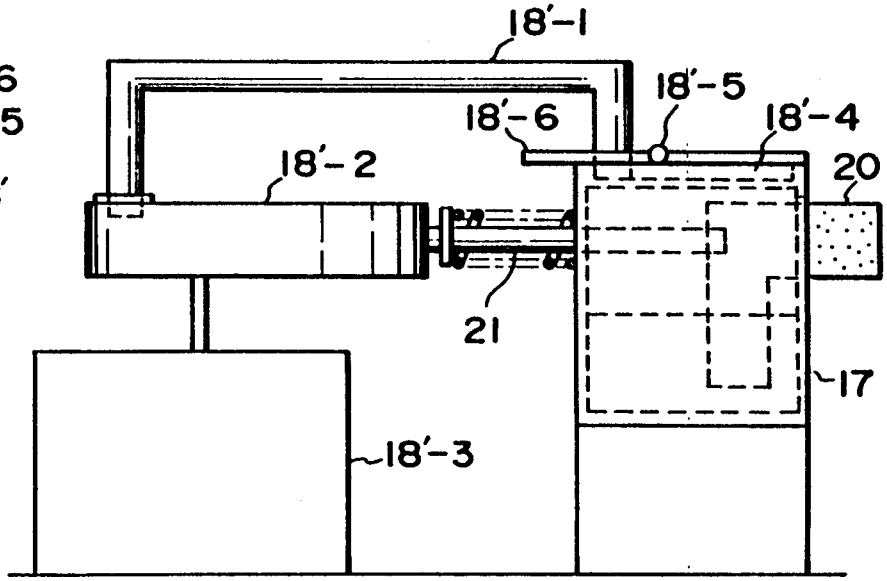
Figure 7A:
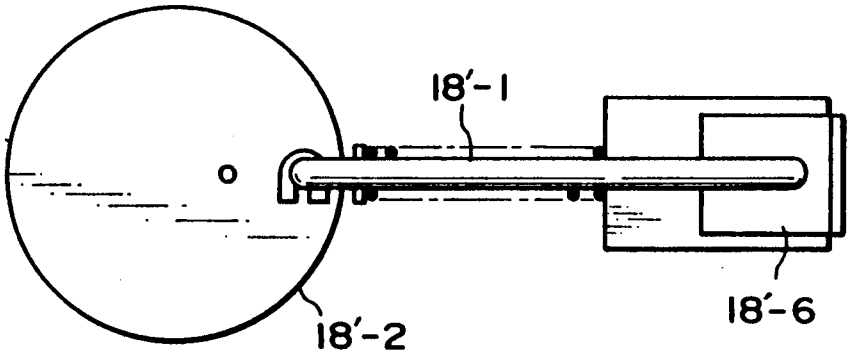
Figure 7B:
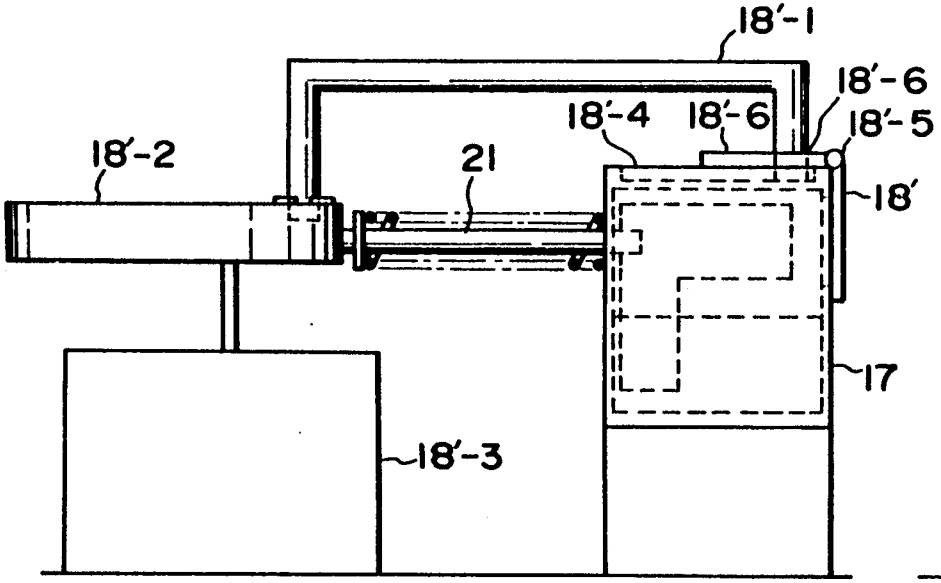

FIGS. 7A and 7B show a top plan view and a side view, respectively, of the closure plate 18′ as it closes an opening 19 through which the coating plate 20 of the liquid-repellent agent storage container 17 can protrude, and FIGS. 8A and 8B show a top plan view and a side view, respectively, of the closure plate 18' as it is moved to uncover the opening 19.

As shown, when the motor 18'-3 is driven, the cam 18'-2 is rotated As regards the moving bar 18'-1 fitting to the closure plate 18', the portion thereof journalled to the cam 18'-2 is moved with of the moving bar 18'-1 is moved along the groove 18'-4. That end portion of the moving bar 18'-1 which is fitted to the groove 18'-4 extends through a hole formed in the moving plate 18'-6. Accordingly, movement of the moving bar 18'-1 caused by the rotation of the cam 18'-2 directly causes movement of the moving plate 18'-6. The moving plate 18'-6 is rotatably connected to the closure plate 18' by the pivotal portion 18'-5. Accordingly, leftward movement of the moving plate 18'-6 as viewed in the figures first causes upward movement of the closure plate 18', and then causes leftward movement of the closure plate as viewed in the figures.

The coating plate 20 is moved back and forth (to the left and right as viewed in the figures) by the movement of the cam likewise rotated by the drive of the motor 18-3. That is, the guide bar 21 is imparted a force by a resilient member 21-1 so as to normally draw the coating plate 20 into the liquid-repellent agent storage container 17. When the point at which the guide bar 21 bears against the cam 18'-2 is deviated due to the rotation of the cam 18'-2, the guide bar 21 is pushed rightwardly as viewed in the figures and along therewith, the coating plate 20 is moved rightwardly as viewed in the figure. At this time, the closure plate 18' uncovers the opening 19 as previously mentioned and therefore, the coating plate 20 protrudes from the opening without any resistance. Of course, it will be understood from the figures that even if the movement of the coating plate 20 is slightly earlier, the movement of the coating plate 20 will not be hampered by the closure plate 18'.

The motor 18'-3 is stopped from driving when it has driven the cam by a predetermined amount or for a predetermined time or when a predetermined amount of movement of the coating plate has been detected. In this state, the liquid-repellent agent is imparted to the recording head. When the impartation of the liquid-repellent agent is terminated, the motor is rotated in the reverse direction or is further rotated, and in accordance with the movement of the cam 18'-2 rotated therewith, the respective members are moved in the opposite direction, and a series of operations of the liquid-repellent process means are terminated at a point of time whereat the opening 19 is closed by the closure plate 18'.

Of course, in the present invention, numerous other constructions of the liquid-repellent process means than the above-described liquid-repellent process means are conceivable, but it has been very effective in preventing the closure plate 18' from contacting the recording head that design is made such that the application of the liquid-repellent agent is effected with the terminal end of the closure plate 18' retracted from that end portion of the coating plate 20 which is adjacent to the recording head.

As described above, according to the above-described preferred embodiment of the present invention, when for example, the recording head was directed to the home position, the coating member was protruded from the liquid-repellent process unit toward the recording head, whereby the coating member could be brought into slidable contact with the discharge port surface of the recording head to apply the liquid-repellent agent keeping the liquid-repellent property for the recording liquid while sweeping, thereby providing uniform wetness, and after the process, the coating member was retracted, whereby the unit containing the liquid-repellent agent therein could be kept in its sealed state.

The use of the plate-like coating member as the liquid-repellent process means was very effective because it could also remove the stain of the discharge port surface and the unnecessary recording liquid by the wiping effect.

Further, the whole of the coating member need not always be constructed of a member impregnated with the liquid-repellent agent, but it suffices if at least the surface thereof can retain a sufficient amount of liquid-repellent agent to accomplish the liquid-repellent process, and an impregnated member (for example, a porous member) need not always be used to form the coating member if such a material is used .

Also, the liquid-repellent process has been shown with respect to an example in which the recording head has once been caused to scan, but alternatively, a plurality of processes in which the liquid-repellent process is again carried out after the desiccation of the liquid-repellent agent may be effected In such case, the time required for one process was long, but the interval between the processes could be widened.

The supply of the liquid-repellent agent to the coating member can be accomplished not only by providing the liquid-repellent agent storage container as in the present invention and utilizing the capillary phenomenon therefrom, but also by filling the storage container with a porous member (which may be common to a part of the coating member) and causing the porous member to retain the liquid-repellent agent. In any case, it is of course possible to carry out the process for a long period of time by providing a hole for supply (or supplement) of the liquid-repellent agent in the storage container and providing a play for closing the hole.

The present invention has been shown with respect to an example in which the coating member is movable back and forth and a closure plate is provided, but for example, the coating member may have a closure member like a cap member for the recording head if such closure member can prevent unnecessary desiccation of the coating member.

It will be naturally understood that the liquid-repellent process unit may be provided not only between the recording area and the home position as in the present invention, but within the range over which the recording head is moved.

It will also be understood that the present invention is achieved not only by providing moving means only on the liquid-repellent process means side, but also by providing means movable back and forth on the recording head side as well or only on the recording head side.

Also, it will be effective to bend, for example, the rail for movement of the carriage toward the liquid-repellent process means so that the relative position of the recording head and the liquid-repellent process means comes close with movement of the recording head (the carriage).

That is, the contact and separation between the recording head and the liquid-repellent process means are not limited to those shown in this specification, but numerous modifications thereof are conceivable.

Another preferred embodiment of the present invention will now be described with reference to FIGS. 9 and 10.

Figure 9:
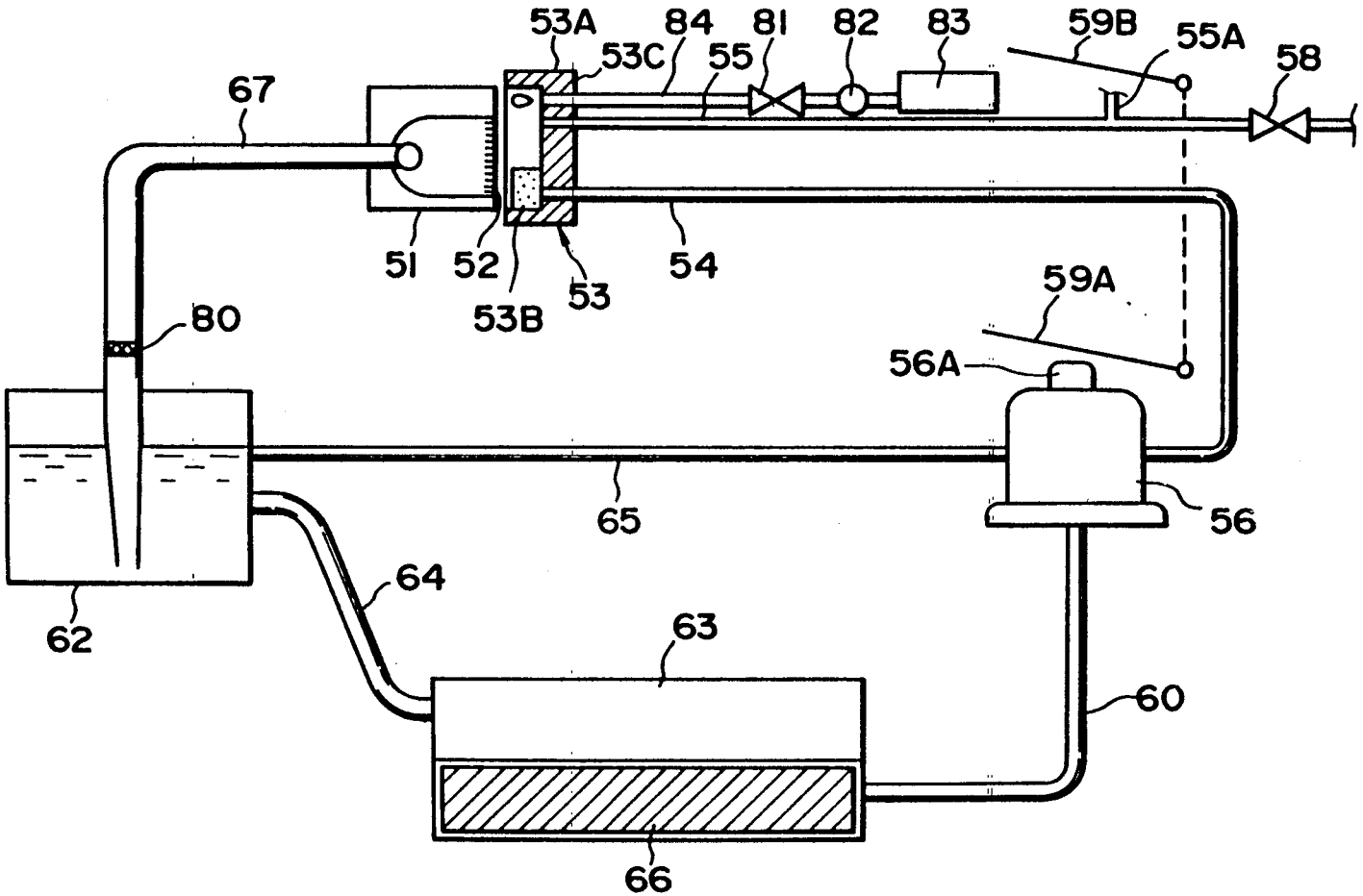
FIGS. 9 and 10 illustrate another preferred embodiment of the present invention, FIG. 9 being a schematic arrangement view of the components of the liquid injection recording apparatus according to this embodiment, and FIG. 10 being a schematic perspective view of the recording apparatus.
Figure 10:
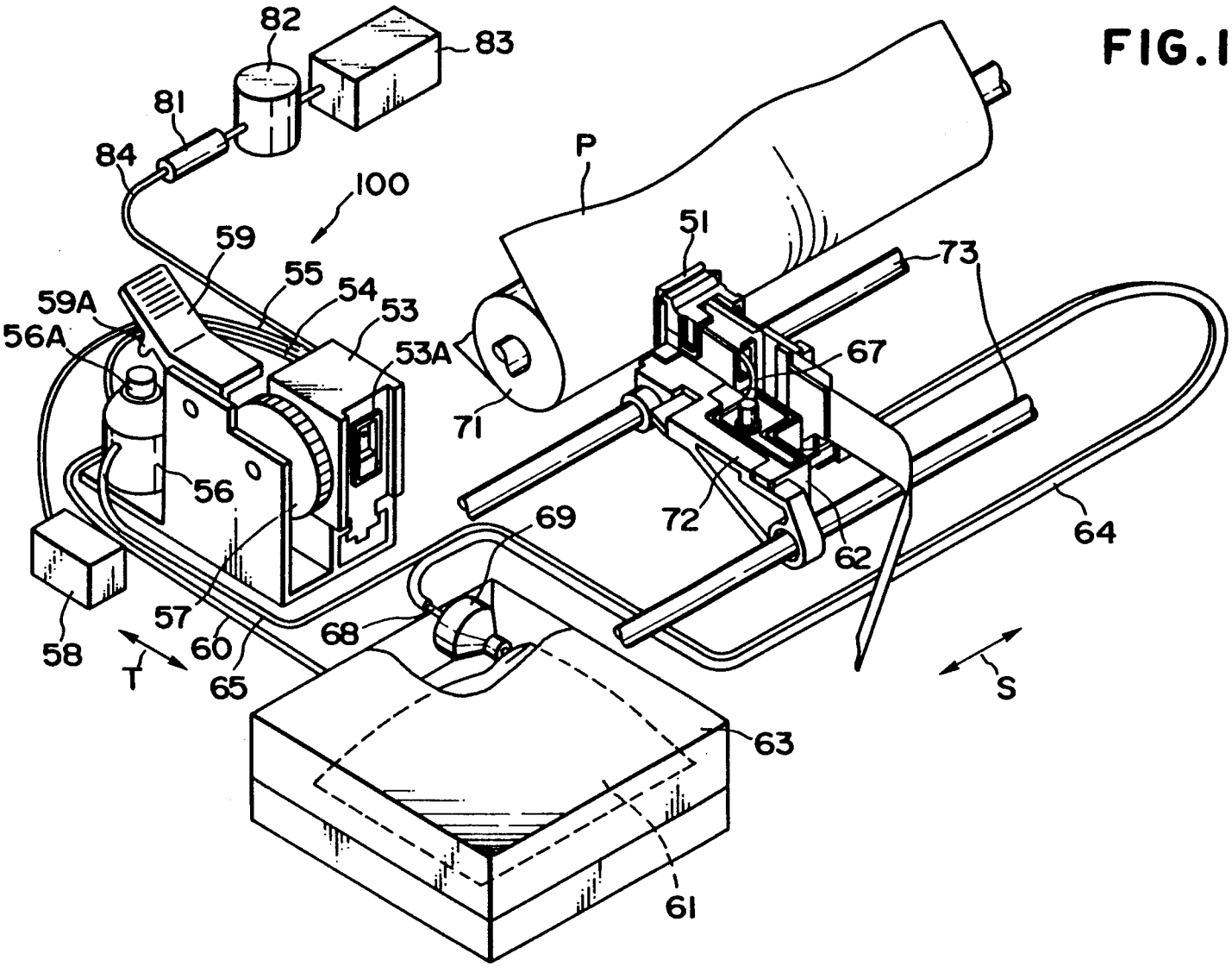

In FIGS. 9 and 10, the reference numeral 51 designates a recording head, the reference numeral 52 denotes a discharge port surface in which the discharge ports of the recording head 51 are disposed, the reference numeral 53 designates cap means, the reference character 53A denotes a packing, the reference character 53B designates an absorbing member, the reference character 53C denotes a liquid-repellent agent injection port, the reference numeral 54 designates a suction tube, the reference numeral 55 denotes an atmosphere-communicating tube, the reference character 55A designates a port opening to the atmosphere, the reference numeral 56 denotes a pump, the reference character 56A designates a piston, the reference numeral 57 denotes a gear for moving the cap means 53, and the reference numeral 58 designates a solenoid valve. The reference numeral 59 denotes a lever, the reference character 59A designates a projection for driving the piston 56A of the pump 56 operatively associated with the lever 59, and the reference character 59B denotes a valve for opening and closing the port 55A opening to the atmosphere. The reference numeral 60 designates a discharge tube, the reference numeral 61 denotes a cartridge, the reference numeral 62 designates a sub-tank, the reference numeral 63 denotes a main tank, the reference numerals 64 and 67 designate supply tubes, the reference numeral 65 denotes a communication tube, the reference numeral 66 designates a waste liquid reservoir, the reference numeral 68 denotes a lead-out member, and the reference numeral 69 designates a sealing member. The reference numeral 71 denotes a platen, the reference numeral 72 designates a carriage, the reference numeral 73 denotes rails, the reference numeral 80 designates a filter, the reference numeral 81 denotes a valve, the reference numeral 82 designates a pump, the reference numeral 83 denotes a tank for liquid-repellent agent, and the reference numeral 84 designates a tube.

In the present embodiment, the liquid-repellent agent injection port 53C is provided in the cap means 53 so as to be opposed to the discharge port surface 52 of the recording head 51. The liquid-repellent agent injection port 53C is provided to supply the liquid-repellent agent in the tank 83 with the valve 81 opened by the use of the pump through the tube connected to the liquid-repellent agent injection port 53C and inject the liquid-repellent agent from the injection port 53C toward the discharge port surface 52.

The sub-tank 62 and the recording head 51 are carried on the carriage 72. The filter 80 is provided in the supply tube 67 for supplying the recording liquid from the sub-tank 62 into the recording head 51. This filter 80 prevents entry of bubbles and foreign materials in the recording liquid into the recording head 51. Communicated with the sub-tank 62 are the supply tube 64 for supplying the recording liquid in the main tank 63 contained in the cartridge 61 into the sub-tank 62 and the communication tube 65 for discharging any excess liquid therethrough so that the recording liquid in the sub-tank 62 assumes a desired amount. The communication tube 65 has one end thereof communicated with the pump 56. The pump 56 pushes down its piston 56A through the lever 59 to thereby produce negative pressure and render the interior of the communication tube 65 and the interior of the suction tube 54 into a negative pressure state. By this nagative pressure, any excess recording liquid in the sub-tank 72 is sucked into the pump 56 through the communication tube 65. The recording liquid which has entered the pump 56 is discharged into the waste liquid reservoir 66 contained in the cartridge 61. On the other hand, the negative pressure produced by the pump 56 is imparted to the absorbing member 53B of the cap means 53 through the suction tube 54.

Actually, when the carriage 72 is returned to the capping position along the rails 73, the cap means 53 is capped onto the discharge port surface 21 of the recording head 51 by a gear being driven by the utilization of the force from a drive force source (not shown) such as a motor. At this time, the port 55A opening to the atmosphere which is communicated with the atmosphere-communicating tube 55 was opened Thereby, the force-in of air from the discharge port into the recording head 51 caused during the capping was prevented. Then, by depressing the lever 59, the port 55A opening to the atmosphere was closed and the piston 56A was pushed down to operate the pump 56. Thereafter, the solenoid valve 58 was opened to communicate the atmosphere-communicating tube 55 with the atmosphere, whereby the space formed between the cap means 53 and the recording head 51 was communicated with the atmosphere. Thereby, any excess recording liquid in said space could be discharged. The thus discharged recording liquid was discharged into the waste liquid reservoir 66 through the pump and the discharge tube 60.

Thereafter, the cap means 53 was separated from the recording head 51 to thereby terminate the capping operation involved in the usual suction restoring operation.

Description will now be made of the liquid-repellent process in the present embodiment.

In the present embodiment, as in the previously described case, the carriage 72 was moved to the capping position and the discharge port surface 52 of the recording head 51 was capped by the cap means 53. This capping operation differed in no way from the capping operation which accompanied the suction restoring operation. When the liquid-repellent process was to be carried out, the pump 82 was operated with the valve 81 opened. By the operation of the pump 82, the liquid-repellent agent contained in the tank 83 arrived at the liquid-repellent agent injection port 53C through the tube 84 and was injected therefrom toward the discharge port surface 52 of the recording head 51. The pump 82 had its driving time, etc determined so that such a degree of amount of liquid-repellent agent which could avoid a problem resulting from excessive impartation of the liquid-repellent agent might be injection toward the discharge port surface 52. When the injection of the liquid-repellent agent was terminated, the valve 81 was closed and the cap means 53 was separated from the recording head 51, whereby the liquid-repellent process was terminated.

Opening the solenoid valve 58 before the cap means 53 was separated from the recording head 51, depressing the lever 59 and driving the pump 56 could remove any liquid-repellent agent left in the cap means 53 and the absorbing member 53B, and thus could solve the problems which would otherwise result from the stain of the interior of the apparatus and the liquid-repellent agent left. Moreover, this was a very effective means because in this case, there was no change in the number of components of the apparatus.

Also, in the case of the present embodiment, the valve 81 was provided to prevent the liquid-repellent agent from being inadvertently injected by the negative pressure resulting from the suction restoring operation and to prevent the suction of the liquid from the discharge ports from becoming impossible due to that injection. However, if the pump 82 is chosen, the negative pressure produced by the pump 56 can be stopped by the pump 82 and therefore, the valve 81 need not always be provided.

Also, in the present embodiment, simpler liquid-repellent process means was constructed by intactly using a part of the construction for the suction restoring process, but depending on the design requirements of the entire apparatus, respective mechanisms may be provided discretely.

Of course, a stable liquid-repellent process could be carried out for a long period of time by providing the tank 83 with a hole for supplementing the liquid-repellent agent or by making the tank 83 interchangeable as a liquid-repellent agent cartridge.

The liquid-repellent process carried out in the present embodiment will now be described with reference to FIG. 11 in connection with the flow of the operation of the entire apparatus and the recording operation.

By closing the main switch of the apparatus, the liquid-repellent process flow is started (110), Next, the print number (the number of one character printed) n is rendered into n=0 (111), whereafter the number of prints is counted up to the initial set value No (112 and 113). Subsequently, the number of characters actually printed is counted, and is compared with the number N of prints set as the liquid-repellent process interval (114 and 118). When the condition that $N \leqq n$ is reached, the carriage is returned to the home position or the capping position (115), whereafter the liquid-repellent process is carried out (116). After the liquid-repellent process is carried out, n is restored to 0 and the number of prints is counted (117 and 118), and said flow is continued.

Figure 11:
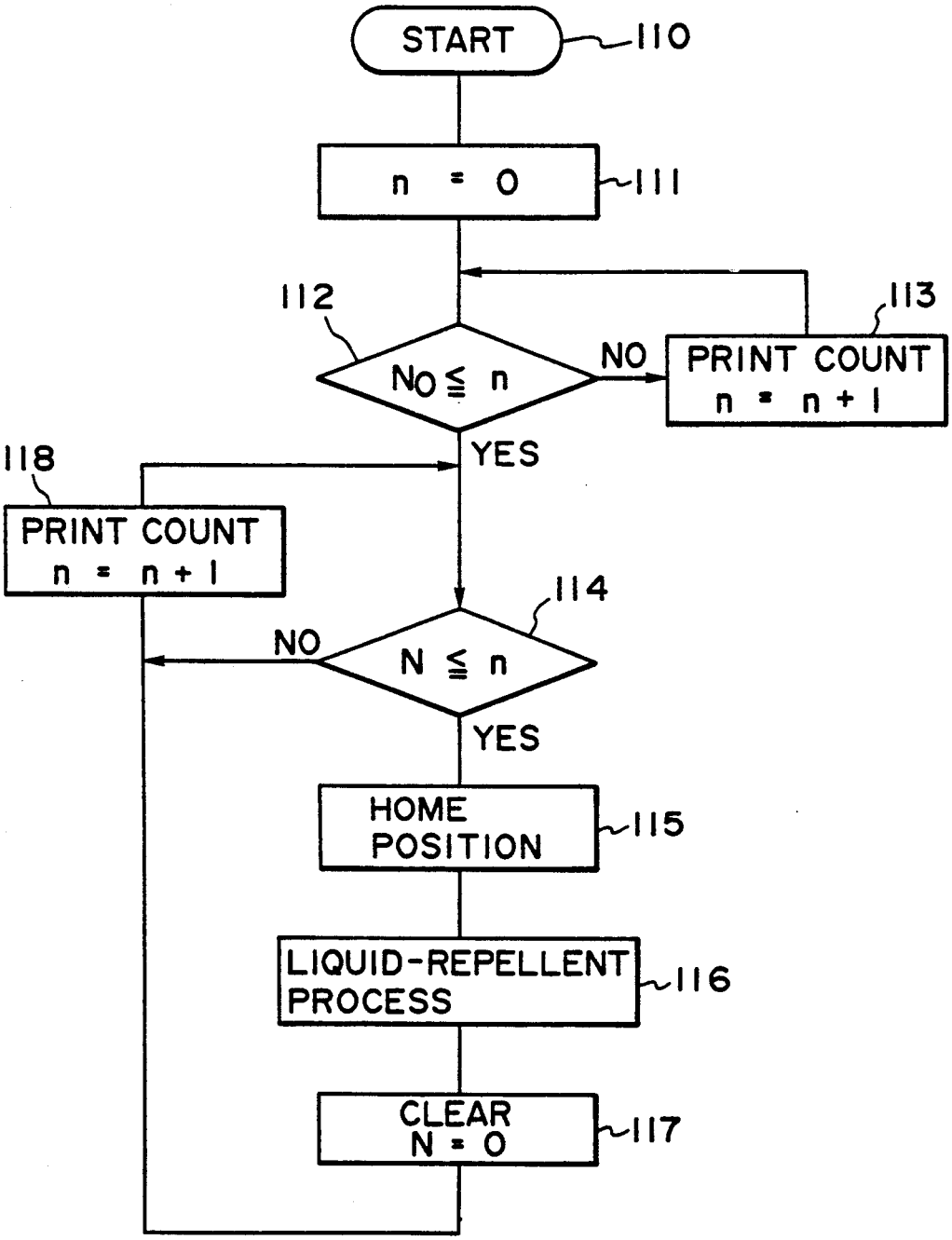
FIGS. 11 and 12 are flow charts for illustrating an example of the flow of the liquid-repellent process in another preferred embodiment of the present invention.

In the present embodiment, a very good result could be obtained by carrying out the liquid-repellent process in accordance with the flow shown in FIG. 11, but when the liquid-repellent process was carried out not in the middle of printing but each time the page was renewed, interruption of printing did not occur and a very efficient liquid-repellent process could be accomplished. Also, it has been found at the same time that in most cases, by making the set value of the liquid-repellent process interval N suitable, no inconvenience occurs even if the liquid-repellent process is a little delayed. The flow in the case where the liquid-repellent process is carried out when the page is renewed (119) is shown in FIG. 12.

As regards said initial set condition No, the counted number of characters printed, for example, from the preceding liquid-repellent process until the main switch of the apparatus is opened may be stored in a memory and the numerical value stored in the memory may be used when the main switch is closed. Alternatively, a suitable numerical value may be predetermined and that numerical value may be used as No when the main switch is closed.

Also, the counting of the number of prints may be changed in conformity with the specification of the apparatus, the design conditions of the apparatus, the way in which the apparatus is used, etc., such as the number of times of the liquid discharge from a discharge port, the total number of times of the liquid discharge from all discharge ports of a recording head, the number of times of the liquid discharge from one of all discharge ports of a recording head in which discharge takes place most frequently, and the number of times of the liquid discharge from selected one of the discharge ports of a recording head.

Figure 12:
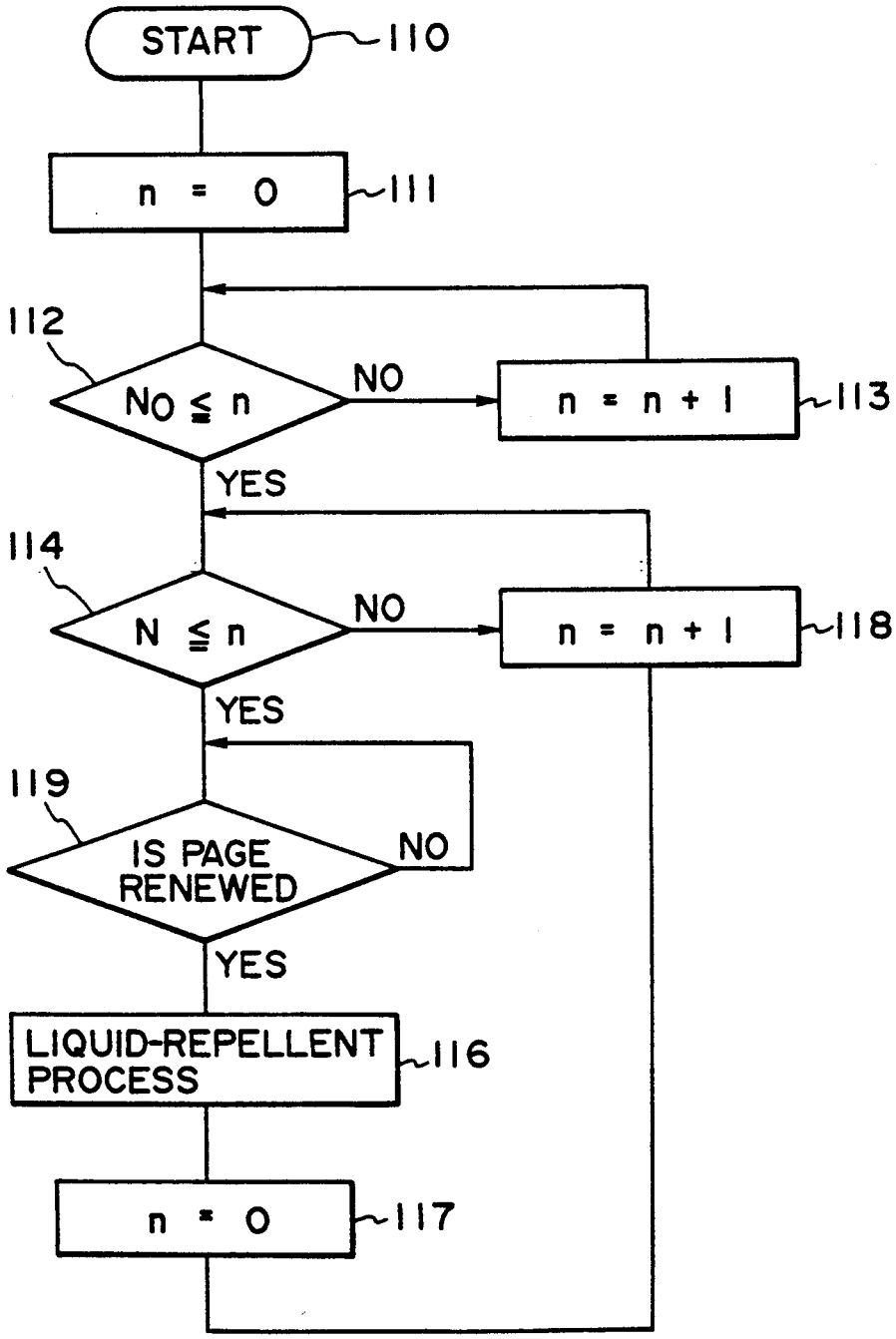

It will also be understood that if in the flow shown in FIGS. 11 and 12, n is reread as the number of scans of the carriage, this flow can be used as the flow of the aforedescribed embodiment.

Of course, the flow shown in FIGS. 11 and 12 could be applied to any apparatus having liquid-repellent process means. Also, a block diagram for achieving this is that shown in FIG. 6, and it could be achieved by counting the output pulses from the head driver 1003.

FIG. 13 show another embodiment of the liquid-repellent process means of the present invention.

Figure 13A:
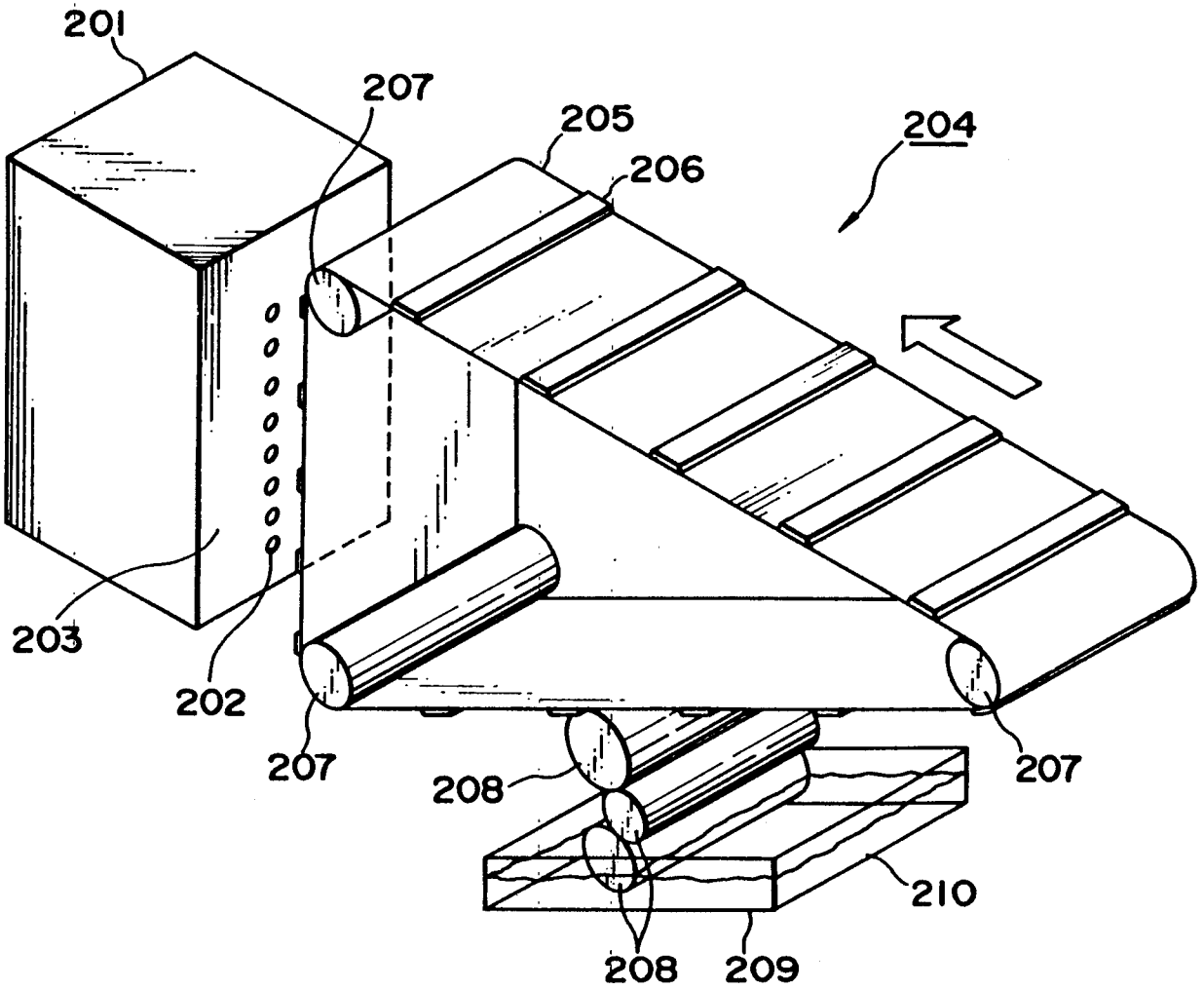
FIGS. 13A, 13B and 14 are schematic perspective view for illustrating further forms of the liquid-repellent process means.

Referring to FIG. 13A, the reference numeral 201 designates a recording head, the reference numeral 202 denotes discharge ports, and the reference numeral 203 designates a discharge port surface The reference numeral 204 denotes liquid-repellent process means which has a belt 205, porous members 206, rollers 207, liquid-repellent agent imparting rollers 208 and a liquid-repellent agent container 209 containing a liquid-repellent agent 210 therein.

The present embodiment is of such structure in which, in the liquid-repellent process position, the liquid-repellent process means 204 and the recording head 201 are opposed to each other, whereafter the liquid-repellent process means 204 and the recording head are moved back and forth relative to each other by moving means, not shown, whereby they bear against each other. Subsequently, the belt 209 is driven in the direction of arrow by belt driving means, not shown, so that the porous members 206 are brought into sliding contact with the discharge port surface 203. As the belt 205 is moved, the liquid-repellent agent 210 contained in the liquid-repellent agent container 209 may be imparted to the porous members 206 in succession by the liquid-repellent agent imparting rollers.

In the present embodiment, there have been obtained the effects that the porous members 206 can slidably contact the discharge port surface 203 for a desired time and that it is easy to control the amount of liquid-repellent agent retained by the porous members 206 by the liquid-repellent agent imparting rollers 208. Also, similar effects have been obtained even if the entire belt is formed of a porous material Further, the liquid-repellent agent imparting rollers need not be multiple, but may be single.

Figure 13B:
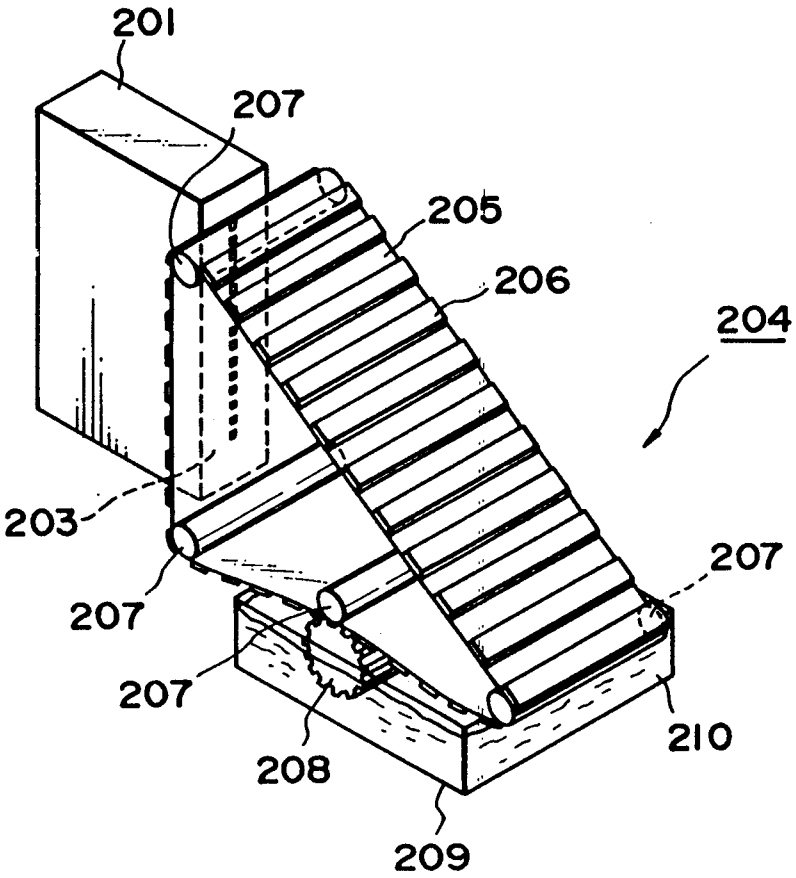

FIG. 13B shows a modification of the liquid-repellent process means shown in FIG. 13A in which a single liquid-repellent agent imparting roller is employed and the roller is formed with grooves.

Figure 14:
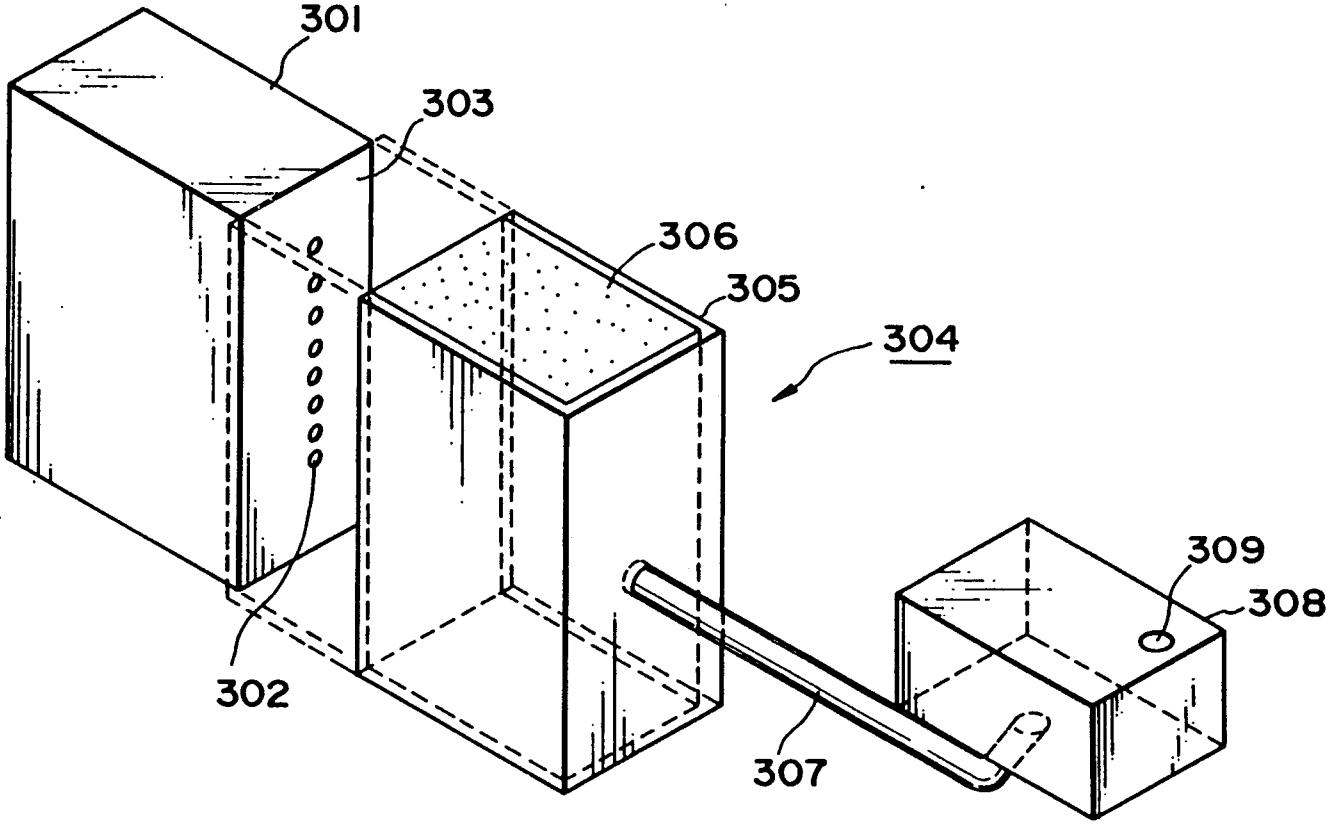

FIG. 14 shows another embodiment of the liquid-repellent process means according to the present invention.

In FIG. 14, the reference numeral 301 designates a recording head, the reference numeral 302 denotes a discharge ports, and the reference numeral 303 designates a discharge port surface. The liquid-repellent process means 304 has a porous material 306 contained in a frame 305, a tube 307 for supplying a liquid-repellent agent to the porous material 306, and a liquid-repellent agent container 308 containing the liquid-repellent agent therein.

Again in the present embodiment, design is made such that the recording head 301 and the liquid-repellent process means 304 are opposed to each other and thereafter are moved relative to each other so that the discharge port surface 303 of the recording head 301 and the porous material 306 can bear against each other. Since the liquid-repellent agent contained in the liquid-repellent agent container 308 was supplied to the porous material 306 through the tube 307, the liquid-repellent process could be carried out simply by the porous material 306 bearing against the discharge port surface of the recording head 301. Slightly moving the recording head 301 at this time was effective in accomplishing uniform coating. Further, the liquid-repellent agent container is provided with an aperture 309 for communicating the interior thereof with the atmosphere, whereby not only the supply of the liquid-repellent agent to the porous material 306 can be accomplished smoothly, but also supplementation of the liquid-repellent agent can be accomplished through said aperture The present embodiment does not require the liquid-repellent agent to be imparted by a pump, a motor or the like, and this leads to the advantage that the construction can be simplified.

Figure 15:
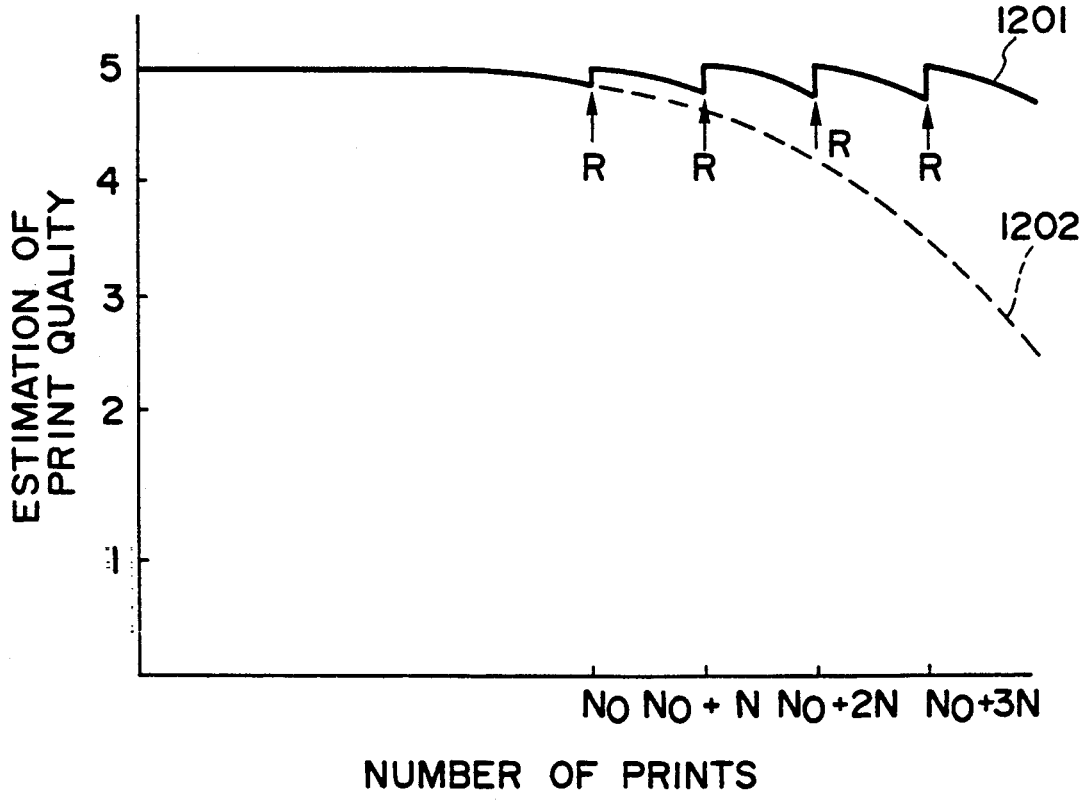
FIG. 15 is graph for illustrating the effect of the liquid-repellent process according to the present invention.

FIG. 15 shows an example of the result of the comparison made between a case 1201 where the liquid-repellent process (indicated by R in the graph) is carried out each time printing is effected by a desired number of prints N and a case 1202 where the liquid-repellent process is carried out only once. The estimation of print quality herein referred to means the average estimation when the reduction in print quality caused by the deviation of the direction of flight of a liquid droplet, any variation in the speed of flight of the liquid droplet, any variation in the volume of the flying liquid droplet, etc. is estimated at five grades by a test of organic functions when the initial performance is "5".

As shown in FIG. 15, by the liquid-repellent process being carried out each desired number of times as in the present invention, the print quality could substantially restore its initial level and the deterioration of the print quality with lapse of time could be minimized.

As described above, according to the present invention, there is provided a liquid injection recording apparatus provided with liquid-repellent process means which is of very simple structure and capable of reliably accomplishing the liquid-repellent process of the discharge port surface of the recording head.

Also, according to the present invention, there is provided a liquid injection recording apparatus in which the liquid-repellent effect is ensured and therefore the direction of discharge of liquid droplets is not disturbed and recording of high quality can be accomplished.

In addition, according to the present invention, the range of selection of the substance as the liquid-repellent agent for carrying out the liquid-repellent process can be widened.

In the present invention, the liquid-repelling work does not require skill, and if control means for controlling the liquid-repellent process is provided in the apparatus, even another problem which would be caused by the liquid-repellent process can be solved.

Also, carrying out the liquid-repellent process when the page is renewed can be accomplished without adversely affecting the recording operation.

We claim:

1. A liquid injection recording apparatus adapted to discharge recording liquid from discharge ports provided in a discharge port surface of a recording head to make flying liquid droplets to thereby accomplish recording, comprising a recording head having a discharge port surface with discharge ports provided therein and liquid-repellent process means capable of applying a liquid-repellent agent to said discharge port surface for repelling the recording liquid adhering to said discharge port surface provided at a position capable of being opposed to said discharge port surface, said liquid injection recording apparatus further comprising reciprocating means for reciprocally moving said recording head a plurality of times after said liquid-repellent agent is applied to said discharge port surface and before said recording apparatus accomplishes further recording.

2. A liquid injection recording apparatus according to claim 1, characterized in that said position capable of being opposed to said discharge port surface is near the home position of said recording head.

3. A liquid injection recording apparatus according to claim 1, characterized in that said liquid-repellent process means has a porous member.

4. A liquid injection recording apparatus according to claim 3, characterized in that said porous member is divided and disposed on a belt-like member.

5. A liquid injection recording apparatus according to claim 4, characterized in that said liquid-repellent process means has a liquid repellent agent imparting roller for imparting the liquid-repellent agent to said belt-like member.

6. A liquid injection recording apparatus according to claim 3, characterized in that said porous member is a belt-like member.

7. A liquid injection recording apparatus according to claim 6, characterized in that said liquid-repellent process means has a liquid-repellent agent imparting roller for imparting the liquid-repellent agent to said belt-like member.

8. A liquid injection recording apparatus according to claim 1, characterized in that said liquid-repellent process means has a plate-like porous member.

9. A liquid injection recording apparatus according to claim 1, characterized in that said liquid-repellent process means has a porous member and moving means for moving back and forth relative to said recording head.

10. A liquid injection recording apparatus according to claim 9, charactertized in that said moving means has a motor, a cam moved by said motor, and guide means having one end thereof in contact with said cam and moving said porous member by the rotation of said cam.

11. A liquid injection recording apparatus according to claim 9, characterized in that said liquid-repellent process means has a liquid-repellent agent storage container containing said porous member therein.

12. A liquid injection recording apparatus according to claim 11, characterized in that said liquid-repellent agent storage container of said liquid-repellent process means has an opening through which said porous member can protrude.

13. A liquid injection recording apparatus according to claim 12, characterized in that said liquid-repellent process means has a closure member for opening and closing said opening.

14. A liquid injection recording apparatus according to claim 13, characterized in that said closure member is connected to a moving member for opening and closing said opening in response to the movement of said porous member of said liquid-repellent process means.

15. A liquid injection recording apparatus according to claim 9, characterized in that said moving means is a solenoid.

16. A liquid injection recording apparatus according to claim 1, characterized in that said recording head and said liquid-repellent process means have moving means for moving them back and forth relative to each other at said position capable of being opposed.

17. A liquid injection recording apparatus according to claim 1, wherein said recording head has a discharge energy generating element for forming a bubble in response to a recording signal and discharging a flying liquid droplet.

18. The liquid injection recording apparatus of claim 1, wherein a recordable state is defined after said reciprocating means reciprocate said recording head said plurality of times.

19. A liquid injection recording apparatus having a recording head having a discharge port surface in which discharge ports for discharging liquid therethrough are disposed, recording head moving means for making said recording head reciprocally movable along a recording medium, liquid-repellent process means provided within the range of movement of said recording head so as to be capable of being opposed to said discharge port surface for applying a liquid-repellent agent repelling said liquid to said discharge port surface, and control means for counting the number of times of the movement of said recording head and effecting the liquid-repellent process on said discharge port surface on the basis of said count information.

20. A liquid injection recording apparatus according to claim 19, wherein said control means has counting means for counting said number of times of the movement.

21. A liquid injection recording apparatus according to claim 19, wherein said count is based on the output from the position sensor of a carriage on which said recording head is disposed.

22. A liquid injection recording apparatus according to claim 19, wherein said liquid-repellent process means has a porous member.

23. A liquid injection recording apparatus according to claim 22, wherein said porous member is divided and disposed on a belt-like member.

24. A liquid injection recording apparatus according to claim 23, wherein said liquid-repellent process means has a liquid-repellent agent imparting roller for imparting the liquid-repellent agent to said belt-like member.

25. A liquid injection recording apparatus according to claim 22, wherein said porous member is a belt-like member.

26. A liquid injection recording apparatus according to claim 25, wherein said liquid-repellent process means has a liquid-repellent agent imparting roller for imparting the liquid-repellent agent to said belt-like member.

27. A liquid injection recording apparatus according to claim 19, wherein said liquid-repellent process means has a plate-like porous member.

28. A liquid injection recording apparatus according to claim 19, wherein said liquid-repellent process means has a porous member and moving means for moving back and forth relative to said recording head.

29. A liquid injection recording apparatus according to claim 28, wherein said moving means has a motor, a cam rotated by said motor, and guide means having one end thereof in contact with said cam and moving said porous member by the rotation of said cam.

30. A liquid injection recording apparatus according to claim 29, wherein said liquid-repellent process means has a liquid-repellent agent storage container containing said porous member therein.

31. A liquid injection recording apparatus according to claim 30, wherein said liquid-repellent agent storage container of said liquid-repellent process means has an opening through which said porous member can protrude.

32. A liquid injection recording apparatus according to claim 31, wherein said liquid-repellent process means has a closure member for opening and closing said opening.

33. A liquid injection recording apparatus according to claim 32, wherein said closure member is connected to a moving member for opening and closing said opening in response to the movement of said porous member of said liquid-repellent process means.

34. A liquid injection recording apparatus according to claim 28, wherein said moving means is a solenoid.

35. A liquid injection recording apparatus according to claim 19, wherein said recording head and said liquid-repellent process means have moving means for moving them back and forth relative to each other at said position capable of being opposed.

36. A liquid injection recording apparatus according to claim 19, wherein said recording head has a discharge energy generating element for forming a bubble in response to a recording signal and discharging a flying liquid droplet.

37. A liquid injection recording apparatus comprising a recording head having a discharge port surface with discharge ports for discharging liquid therethrough, and control means for counting the number of prints printed by said recording head and controlling the application of liquid-repellent on said discharge port surface by a liquid repellent process means on the basis of said count information, wherein said liquid injection recording apparatus further comprising reciprocating means for reciprocally moving said recording head a plurality of times after said liquid-repellent is applied to said discharge port surface and before said recording apparatus accomplishes further printing.

38. A liquid injection recording apparatus according to claim 37, wherein said recording head has a discharge energy generating element for forming a bubble in response to a recording signal and discharging a flying liquid droplet.

39. The liquid injection recording apparatus of claim 37, wherein a recordable state is defined after said reciprocating means reciprocate said recording head said plurality of times.

40. A liquid-repellent process method comprising the steps of determining whether or not a predetermined condition is satisfied;

effecting the application of liquid-repellent by liquid-repellent process means on a discharge port surface of a recording head in which discharge ports for discharging liquid therethrough are disposed when said predetermined condition is satisfied; and reciprocally moving said recording head after effecting said liquid-repellent to said discharge port surface before said recording head accomplishes further recording.

41. A liquid-repellent process method according to claim 40, wherein said predetermined condition is the number of scans of said recording head.

42. A liquid-repellent process method according to claim 40, wherein said predetermined condition is the number of prints effected by said recording head.

43. A liquid-repellent process method according to claim 40, wherein said predetermined condition is the number of driving pulses applied to said recording head.

44. The liquid-repellent process method of claim 40, wherein after said liquid repellent process is effected, said recording head is reciprocally moved a plurality of times before further recording occurs.

45. A liquid-repellent process method for a liquid injection recording apparatus comprising the steps of selecting a recording head having a discharge port surface in which discharge ports for discharging liquid therethrough are disposed, recording head moving means capable of moving said recording head along a recording medium, and liquid-repellent process means for effecting the liquid-repellent process on said discharge port surface, effecting said liquid-repellent process on said discharge port surface by said liquid-repellent process means when the movement of said recording head has reached a predetermined number, and said recording head moving means reciprocally moving said recording head after effecting said liquid-repellent process on said discharge port surface before said recording head accomplishes additional recording.

46. The liquid-repellent process method of claim 45, wherein after said liquid repellent process is effected, said recording head is reciprocally moved a plurality of times before further recording occurs.

47. A liquid-repellent process method for a liquid injection recording apparatus comprising the steps of selecting a recording head having a discharge port surface in which discharge ports for discharging liquid therethrough are disposed, and liquid-repellent process means for effecting the liquid-repellent process on said discharge port surface, effecting said liquid-repellent process by said liquid-repellent process means when the number of prints by said recording head or the number of driving pulses for discharging the liquid from said recording head has reached a predetermined number, and reciprocally moving said recording head after effecting said liquid-repellent process to said discharge port surface before said recording head accomplishes further recording.

48. The liquid-repellent process method of claim 47, wherein after said liquid repellent process is effected, said recording head is reciprocally moved a plurality of times before further recording occurs.

49. A liquid jet recording apparatus comprising:

a discharge area having a discharge portion for holding liquid for a flying liquid droplet formed by a discharge energy generating element for generating discharge energy in accordance with a recording signal;

a mechanism for applying repellent agent to a surface of said discharge area, said repellent agent being capable of preventing said liquid from depositing on said surface of said discharge area; and said liquid jet recording apparatus further comprising reciprocating means for reciprocally moving said discharge area a plurality of times after said repellent agent is applied to said discharge area surface and before said liquid jet recording apparatus accomplishes further recording.

50. A liquid jet recording apparatus according to claim 49, wherein said repellent agent is preapplied to said discharge area before recording and said applying mechanism applies said repellent agent to said discharge area after a predetermined recording operation is completed.

51. A liquid jet recording apparatus according to claim 50, further comprising a cleaning member for rubbing said discharge area.

52. A liquid jet recording apparatus according to claim 49, wherein said discharge energy generating element is a bubble jet type element.

53. The liquid jet recording apparatus of claim 49, wherein a recordable state is defined after said reciprocating means reciprocate said recording head said plurality of times.

* * * * *

UNITED STATES PATENT AND TRADEMARK OFFICE

CERTIFICATE OF CORRECTION

PATENT NO. : 5,005,024

DATED : April 2, 1991

INVENTOR(S) : Hiroto Takahashi, et al

It is certified that error appears in the above-identified patent and that said Letters Patent is hereby corrected as shown below:

On the title page:

IN [30] FOREIGN APPLICATION PRIORITY DATA

"Mar. 14, 1988 [JP] Japan ..... 63-0760102
Mar. 14, 1988 [JP] Japan ..... 63-0760105"

should read

--Mar. 14, 1988 [JP] Japan ..... 63-060102
Mar. 14, 1988 [JP] Japan ..... 63-060105--.

COLUMN 1

Line 43, "$SiO_2$" should read --$SiO_2$ layer--.
Line 47, "of the accompanying" and "of the" should be deleted.
Line 48, ""accompanying" should be deleted.
Line 51, "of kink" should read --kink--.

COLUMN 2

Line 5, "skill liquid-" should read --skill so that too much liquid- --.
Line 24, "such as" should read --and-- and "resistance to the" should read --resistance, rather than an optimal--.

COLUMN 3

Line 25, "that in" (both occurrences) should be deleted.

UNITED STATES PATENT AND TRADEMARK OFFICE

CERTIFICATE OF CORRECTION

PATENT NO. : 5,005,024

DATED : April 2, 1991

INVENTOR(S) : Hiroto Takahashi, et al

It is certified that error appears in the above-identified patent and that said Letters Patent is hereby corrected as shown below:

COLUMN 5

Line 23, "be" should be deleted.

COLUMN 6

Line 43, "scans That" should read --scans. That--.

COLUMN 7

Line 6, "with of" should read --with the movement of the cam 18'-2. Thereby the other end of--.

COLUMN 8

Line 40, "play" should read --plate--.

COLUMN 10

Line 1, "sub-tank 72" should read --sub-tank 62--.

COLUMN 12

Line 41, "rollers." should read --rollers 208.--.
Line 61, "a" should be deleted.

COLUMN 14

Line 49, "charactertized" should read --characterized--.

UNITED STATES PATENT AND TRADEMARK OFFICE

CERTIFICATE OF CORRECTION

PATENT NO. : 5,005,024

DATED : April 2, 1991

INVENTOR(S) : Hiroto Takahashi, et al

It is certified that error appears in the above-identified patent and that said Letters Patent is hereby corrected as shown below:

COLUMN 16

Line 43, "comprising" should read --comprises--.

Signed and Sealed this

Twenty-second Day of December, 1992

*Attest:*

DOUGLAS B. COMER

*Attesting Officer*

*Acting Commissioner of Patents and Trademarks*